US011677185B2

(12) United States Patent
Duval et al.

(10) Patent No.: US 11,677,185 B2
(45) Date of Patent: Jun. 13, 2023

(54) ELECTRICAL CONNECTOR COMPRISING A SECURING TAB

(71) Applicant: Connecteurs Electriques Deutsch, Evreux (FR)

(72) Inventors: Frederic Duval, Evreux (FR); Frederic Tocqueville, Evreux (FR); Thierry Cassar, Evreux (FR)

(73) Assignee: Connecteurs Electriques Deutsch, Evreux (FR)

( * ) Notice: Subject to any disclaimer, the term of this patent is extended or adjusted under 35 U.S.C. 154(b) by 21 days.

(21) Appl. No.: 17/227,961

(22) Filed: Apr. 12, 2021

(65) Prior Publication Data

US 2021/0328380 A1 Oct. 21, 2021

(30) Foreign Application Priority Data

Apr. 16, 2020 (EP) ..... 20315178

(51) Int. Cl.
*H01R 13/639* (2006.01)
*H01R 13/627* (2006.01)

(52) U.S. Cl.
CPC ..... *H01R 13/639* (2013.01); *H01R 13/6277* (2013.01)

(58) Field of Classification Search
CPC ..... H01R 13/639; H01R 13/6277
See application file for complete search history.

(56) References Cited

U.S. PATENT DOCUMENTS 9,350,116 B1 * 5/2016 Morello ..... H01R 13/633
10,122,117 B2 * 11/2018 Miller ..... H01R 13/20
2009/0029584 A1 1/2009 Sami
2014/0235085 A1 8/2014 Su et al.
2016/0064862 A1 3/2016 Nagasaki et al.
2017/0271815 A1 9/2017 Lane et al.
2019/0312386 A1 * 10/2019 Houry ..... H01R 13/62911

FOREIGN PATENT DOCUMENTS

EP 1207591 A2 5/2002
EP 2662937 A1 11/2013
EP 2783450 A1 10/2014

OTHER PUBLICATIONS

Extended European Search Report, dated Sep. 15, 2020, 8 pages.

* cited by examiner

*Primary Examiner* — Tho D Ta
(74) *Attorney, Agent, or Firm* — Barley Snyder

(57) ABSTRACT

An electrical connector includes a housing, a primary locking sleeve disposed on the housing, and a securing tab. The housing has a receptacle open in a connection direction essentially parallel to a longitudinal axis, the receptacle receiving a complementary connector. The primary locking sleeve is movable relative to the housing between a locked position securing the electrical connector and the complementary connector and a release position for connecting and/or disconnecting the electrical connector and the complementary connector. A gap having a gap width is disposed between the housing and the primary locking sleeve at least in the locked position. The gap width decreases from the locked position to the release position. The securing tab is insertable at least partially into the gap to an inserted state to secure the primary locking sleeve in the locked position.

20 Claims, 3 Drawing Sheets

ELECTRICAL CONNECTOR COMPRISING A SECURING TAB

CROSS-REFERENCE TO RELATED APPLICATIONS

This application claims the benefit of the filing date under 35 U.S.C. § 119(a)-(d) of European Patent Application No. 20315178.2, filed on Apr. 16, 2020.

FIELD OF THE INVENTION

The present invention relates to an electrical connector and, more particularly, to an electrical connector having a securing tab.

BACKGROUND

An electrical connector can comprise a housing having a receptacle, the receptacle being open in a connection direction arranged essentially parallel to a longitudinal axis for receiving a complementary connector. The electrical connector can have a primary locking sleeve on the housing that is held movable relative to the housing between a locked position for securing the electrical connector to the complementary connector and a release position for connecting or disconnecting the electrical connector and the complementary connector.

Such electrical connectors are at present utilized for various applications, for example for the connection of two electronic devices, e.g. in a cabin of an aircraft. In such instances, however, the electrical connector may be accessible to laypeople, such as passengers, who may easily disengage the connection between the electrical connector and the complementary connector by moving the primary locking sleeve to the release position. An electrical connector is needed which further secures the connection of the electrical connector and the complementary connector and prevents unintentional disconnection.

SUMMARY

An electrical connector includes a housing, a primary locking sleeve disposed on the housing, and a securing tab. The housing has a receptacle open in a connection direction essentially parallel to a longitudinal axis, the receptacle receiving a complementary connector. The primary locking sleeve is movable relative to the housing between a locked position securing the electrical connector and the complementary connector and a release position for connecting and/or disconnecting the electrical connector and the complementary connector. A gap having a gap width is disposed between the housing and the primary locking sleeve at least in the locked position. The gap width decreases from the locked position to the release position. The securing tab is insertable at least partially into the gap to an inserted state to secure the primary locking sleeve in the locked position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
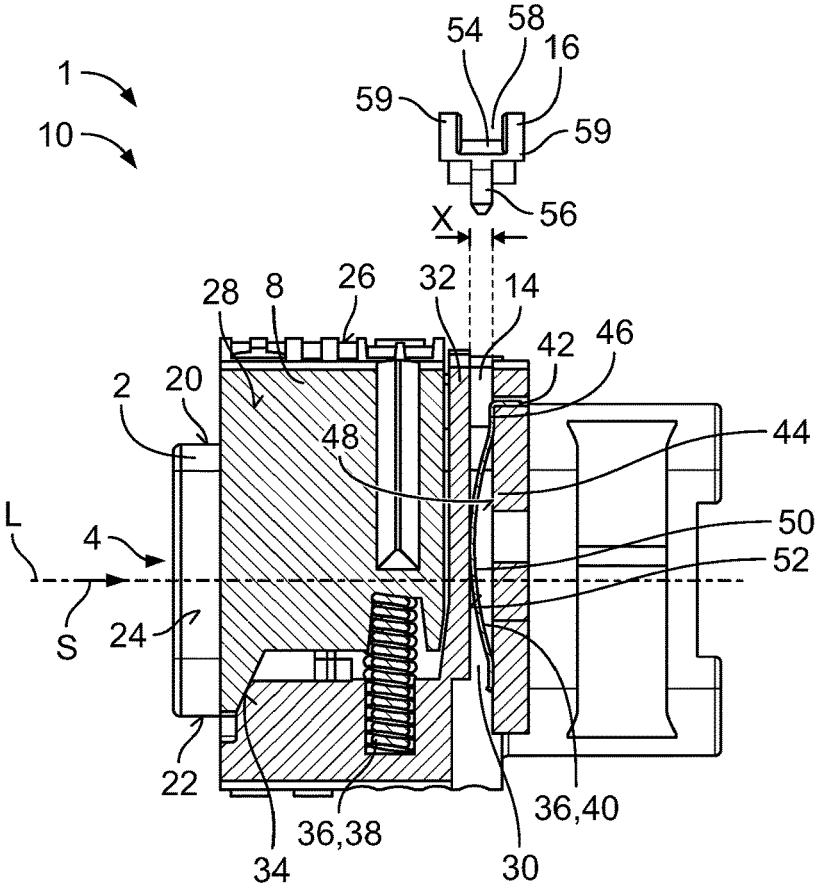
FIG. 1 is a sectional side view of an electrical connector according to an embodiment in a locked position.

In the following, the electrical connector according to the invention is explained in greater detail with reference to the accompanying drawings, in which exemplary embodiments are shown. In the figures, the same reference numerals are used for elements which correspond to one another in terms of their function and/or structure. According to the description of the various aspects and embodiments, elements shown in the drawings can be omitted if the technical effects of these elements are not needed for a particular application, and vice versa: i.e. elements that are not shown or described with reference to the figures but are described herein can be added if the technical effect of those particular elements is advantageous in a specific application.

First, an exemplary embodiment of an electrical connector 1 according to the invention will be described with reference to FIGS. 1-4.

Figure 2:
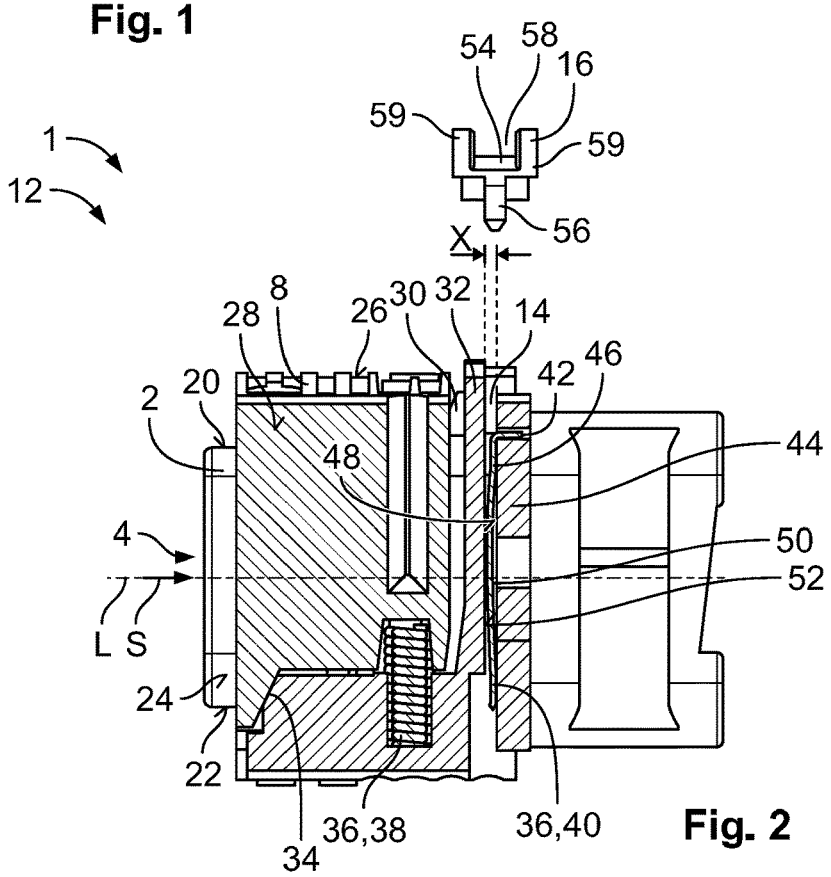
FIG. 2 is a sectional side view of the electrical connector in a release position.
Figure 3:
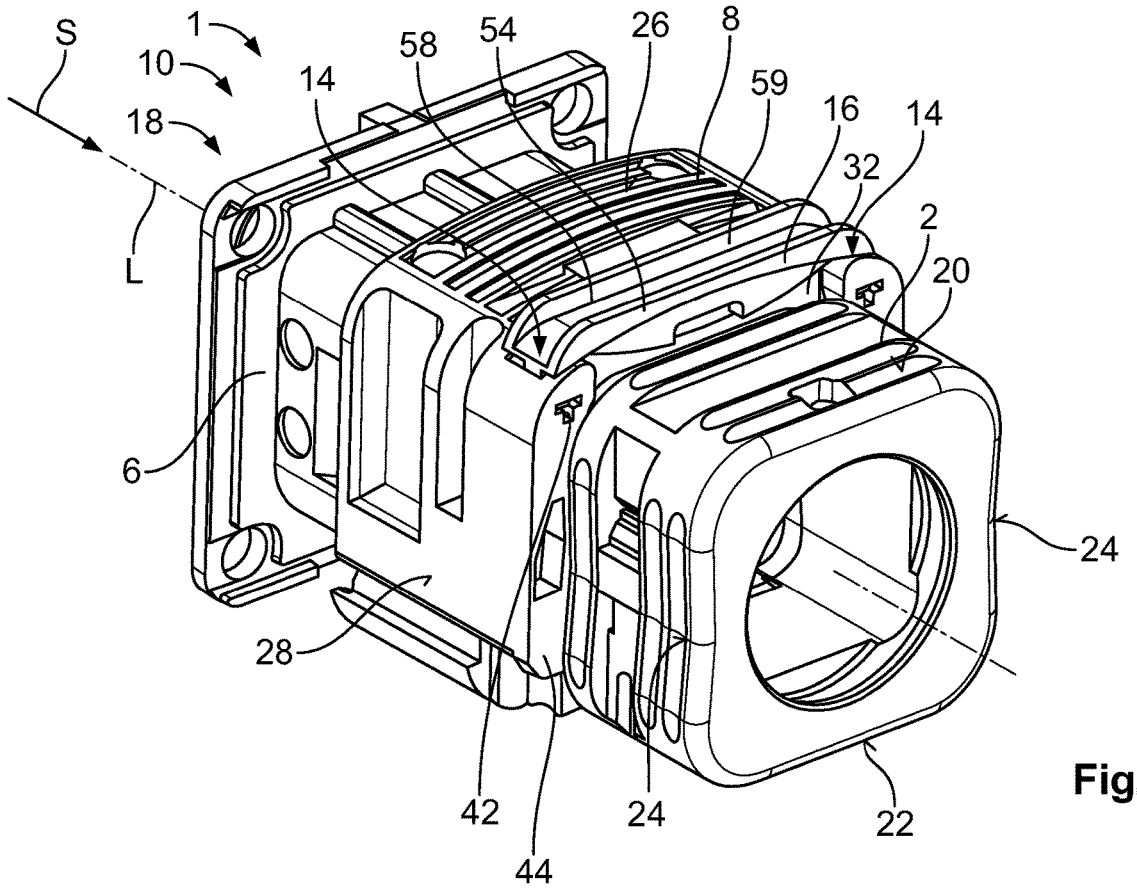
FIG. 3 is a perspective view of the electrical connector with a securing tab in an inserted state.
Figure 4:
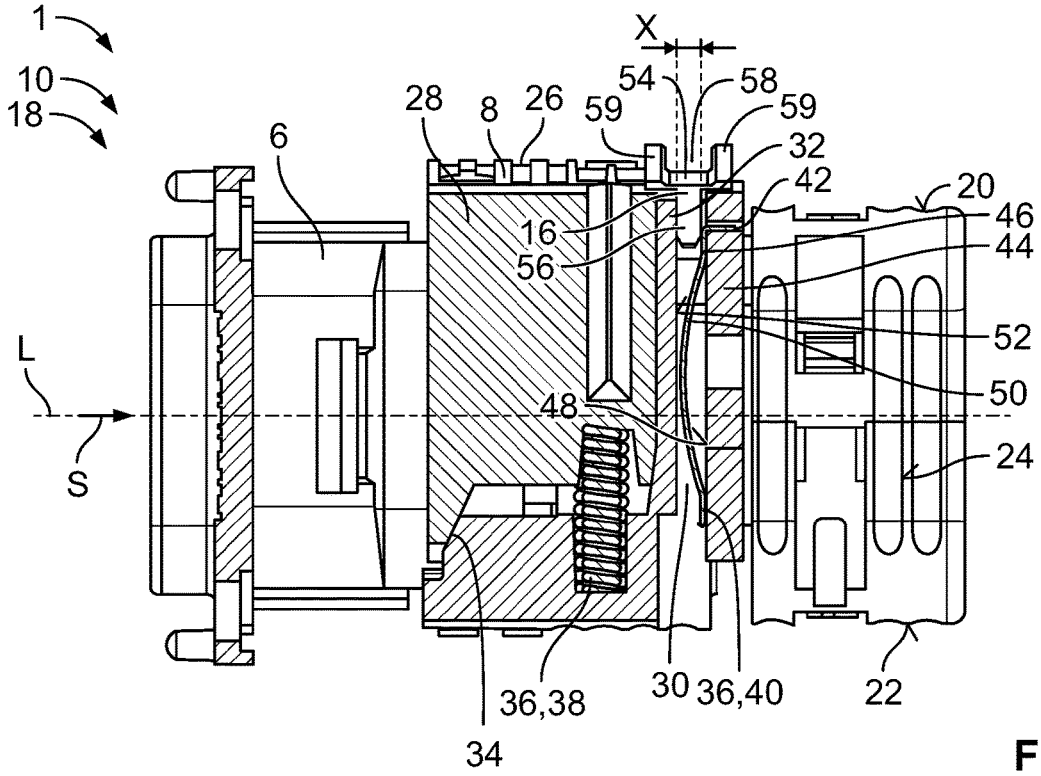
FIG. 4 is a sectional side view of FIG. 3.

The electrical connector 1 comprises a housing 2 having a receptacle 4, the receptacle 4 being open in a connection direction S arranged essentially parallel to a longitudinal axis L for receiving a complementary connector 6 (see FIGS. 3 and 4). The electrical connector 1 further comprises a primary locking sleeve 8 which sits on the housing 2 and is held movable relative to the housing 2 between a locked position 10, as shown in FIG. 1, for securing the electrical connector 1 to the complementary connector 6 and a release position 12, as can be seen in FIG. 2, for connecting or disconnecting the electrical connector 1 and complementary connector 6.

At least in the locked position 10, as shown in FIGS. 1 and 2, a gap 14 having a gap width X is provided between the housing 2 and the primary locking sleeve 8, the gap width X decreasing from the locked position 10 to the release position 12. In order to secure the primary locking sleeve 8 in the locked position 10, a securing tab 16 is provided. The securing tab 16 being adapted to be inserted into the gap 14 for securing the primary locking sleeve 8 in the locked position 10 when the securing tab 16 is in an inserted state 18 shown in FIG. 4, in which the securing tab 16 is inserted into the gap 14.

The complementary connector 6 may, for example, be connected to an electronic device integrated into an aircraft structure. The electrical connector 1 may, for example, be connected to a further connector adapted to connect two pieces of electronic equipment. Therefore, the electrical connector 1 may be an interface adapted to connect two pieces of electronic equipment. The electrical connector 1 may be arranged inside an aircraft cabin, where laypeople, such as passengers, may access the electrical connector 1. Thus, the electrical connector 1 is further secured in the locked position 10 by the securing tab 16 in order to prevent accidental disengagement between the electrical connector 1 and the complementary connector 6.

The housing 2 may be formed, for example, of molded plastic or metal and may comprise an upper wall 20, a lower wall 22 and two lateral sidewalls 24 connecting the upper wall 20 to the lower wall 22 at opposing lateral ends, such that the walls 20-24 circumferentially enclose the receptacle 4, as shown in FIGS. 1-3.

As shown in FIG. 3, the primary locking sleeve 8 may have an overall U-shape, wherein a central portion 26 of the U may be disposed substantially transversely along the upper wall 20 of the housing 2. The side portions 28 of the U extend transversely along the lateral sidewalls 24 of the housing 2. The primary locking sleeve 8 may be a stirrup mounted to the housing 2.

Each side portion 28 may comprise a guide rail 30 arranged on an inner side of the side portion 28 facing the opposite side portion 28, as shown in FIGS. 1 and 2. A flange 32 of the housing 2 projecting radially in a transverse plane of the housing 2, essentially perpendicular to the longitudinal axis L, may be arranged in the guide rail 30 with a play forming the gap 14. Thus, the connection between the guide rail 30 and the flange 32 prevents displacement of the primary locking sleeve 8 relative to the housing 2 along the longitudinal axis L. Consequently, a separate gap 14 is provided for each side portion 28.

The primary locking sleeve 8 may comprise a limit stop arranged on the opposite side of the flange 32 which protrudes radially inward and which may abut the flange 32 in the locked position 10, further limiting the degree of movement between the housing 1 and the primary locking sleeve 8 along the longitudinal axis L. The limit stop may partially form the guide rail 30.

The primary locking sleeve 8 may be movable along the longitudinal axis L relative to the housing 2. In the locked position 10 the primary locking sleeve 8 may be placed further away from a connector interface at which the receptacle 4 is opened compared to the release position 12, in which the primary locking sleeve 8 may be displaced towards the connector interface side. In other words, the primary locking sleeve may be placed further towards the complementary connector 6 in the release position 12 than in the locked position 10.

Additionally, the primary locking sleeve 8 may be adapted to be moved in a direction essentially perpendicular to the longitudinal axis L. In an embodiment, the primary locking sleeve 8 may be actuated by pressing the central portion 26 towards the housing 2. Consequently, the force needed to move the primary locking sleeve 8 from the locked position 10 to the release position 12 may be easily applied by the technician, increasing the user-friendliness. The movement essentially perpendicular to the longitudinal axis L and the movement essentially parallel to the longitudinal axis L of the primary locking sleeve 8 relative to the housing 2 may be coupled to one another. In an embodiment, the movement essentially perpendicular to the longitudinal axis may be translated to the movement essentially parallel to the longitudinal axis L, when moving from the locked position to the release position 12. For this, the housing 2, may comprise a beveled guiding ramp 34 shown in FIGS. 1 and 2 along which the primary locking sleeve 8, particularly the side portions 28, may glide upon movement between the locked position 10 and the release position 12.

In an embodiment, the primary locking sleeve 8 is prestressed towards the locked position 10, such that upon release of the actuation force, the primary locking sleeve 8 may automatically revert to the locked position 10. Consequently, once the latching mechanism of the primary locking sleeve 8 engages the complementary formed latching mechanism of the complementary connector 6 and the actuating force is released, the complementary connector 6 may be automatically pulled towards the receptacle 4. Therefore, a sufficient compression of an interfacial sealing between the connectors 1, 6 in a connected state may be achieved.

In order to create a biasing force for pre-stressing the primary locking sleeve 8 to the locked position 10, biasing springs 36, for example a helicoid biasing spring 38, may be provided at a bottom end of each side portion 28, as shown in FIGS. 1, 2, and 4. Furthermore, a biasing spring blade 40 may be arranged in each gap 14. The biasing spring blade 40 may be mounted in a bearing 42 formed on a radially inward protruding rib 44 of the respective side portion 28, the rib 44 forming a rear end border of the guide rail in the connection direction S. The biasing spring blade 40 may be mounted in the bearing 42 and extend into the gap 14, the biasing spring blade 40 having a resting section 46, which rests on an abutment surface 48 of the rib 44, and an arch section 50 extending from the resting section 46 across the gap 14 and abutting an abutment surface 52 of the flange 32.

Each biasing spring 36 may be compressed upon movement of the primary locking sleeve 8 from the locked position 10 to the release position 12, whereby the helicoid biasing spring 38 may produce a biasing force acting essentially perpendicular to the longitudinal axis L, and the biasing spring blades 40 may produce a biasing force acting essentially parallel to the longitudinal axis L.

In order to allow an easy insertion of the securing tab 16 into the gap 14, the gap 14 may be opened in a direction essentially perpendicular to the longitudinal axis L, as shown in FIGS. 1 and 2. If there is more than one gap 14, the gaps 14 may be formed symmetrically to one another. Hence, each gap 14 may be opened towards the same side. In this exemplary embodiment, the gaps 14 are opened at an upper end at which the upper wall 20 is arranged. Hence, the securing tab 16 may be inserted into the gap 14 through the upper end in a direction essentially perpendicular to the longitudinal axis L.

Two gaps 14 may be provided, the two gaps 14 being arranged on opposing lateral sides between the housing 2 and the primary locking sleeve 8. Therefore, the arrangement between the housing 2 and the primary locking sleeve 8 may be symmetrical, allowing a continuous flow of movement between the primary locking sleeve 8 and the housing 2 without the risk of jamming due to a malposition of the primary locking sleeve 8 and the housing 2.

The securing tab 16, as shown in FIGS. 1-4, may comprise a handle 54 extending transversely from one lateral end to the other lateral end. In the inserted state 18, the handle 54 may be arranged outside the gaps 14, whereby the handle 54 may comprise a shape adapted to nestle against the upper wall 20 of the housing 2, particularly the flange 32. Each lateral end of the handle 54 may be aligned with the respective gap 14, wherein a protrusion 56 may protrude from a bottom surface of the handle 54 at the respective lateral end into the gap 14. Therefore, the protrusion 56 may prevent the decrease of the gap width X and consequently block a movement from the locked position 10 to the release position 12. Therefore, even when accidentally actuating the primary locking sleeve 8, a movement into the release position 12 is prevented. In order to disengage the electrical connector 1 and the complementary connector 6, the securing tab 16 has to be removed from the gap 14 before the primary locking sleeve 8 may be actuated for allowing the disconnection of the connectors 1, 6. The handle 54 being accessible from outside the gap 14 may increase the handleability of the securing tab 16 facilitating the installation and/or removal of the securing tab 16 to or from the remainder of the electrical connector 1. The handle 54 may comprise a further protrusion arranged at the opposite end of the handle 54 for being inserted into the second gap arranged at the opposing lateral side of the electrical connector 1.

In an embodiment, the securing tab 16 may be formed as a monolithic component, e.g. by injection molding. Therefore, a cost-efficient production of the securing tab 16, particularly in large amounts, may be achieved. The primary locking sleeve 8 and the securing tab 16 may be separate parts. The securing tab 16 may, for example, be an accessory component, which may be added to the housing 2 and the primary locking sleeve 8. However, the securing tab 16 may also be pre-mounted to the housing 2 and/or the primary locking sleeve 8, in order to prevent unintentional connection of the complementary connector 6 and the electrical connector 1.

A width of the securing tab 16, particularly a width of the protrusion 56, may be adapted to the width X of the gap 14 in the locked position 10, as shown in FIG. 1, so that the securing tab 16, particularly the protrusion 56, may be fittingly inserted into the gap 14 in the locked position 10. In an embodiment, the securing tab 16 is held in the inserted state 18 shown in FIGS. 3 and 4 by a friction lock. This may, for example, be realized by clamping the protrusion 56 in the gap 14 between the housing 2 and the primary locking sleeve 8, particularly the abutment surfaces of the flange 32 of the housing 2 and the rib 44 of the primary locking sleeve 8.

In the inserted state 18 shown in FIGS. 3 and 4, the protrusion 56 may extend into the gap 14 overlapping the bearing 42 and thus clamping the biasing spring blade 40 between the protrusion 56 and the rib 44 of the primary locking sleeve 8 at the bearing 42. Consequently, the protrusion 56 may further prevent the biasing spring blade 40 from falling out of the bearing 42.

In order to not interfere with the biasing force of the biasing spring blade 40, the protrusion 56 and the arch section 50 of the biasing spring blade 40 may be arranged staggered to one another in a direction essentially perpendicular to the longitudinal axis L. The arch section 50 may for example be arranged laterally offset from the protrusion 56 in an embodiment. In an embodiment, however, the arch section 50 may be arranged deeper inside the gap 14 than the end of the protrusion 56 in the inserted state 18.

Figure 5:
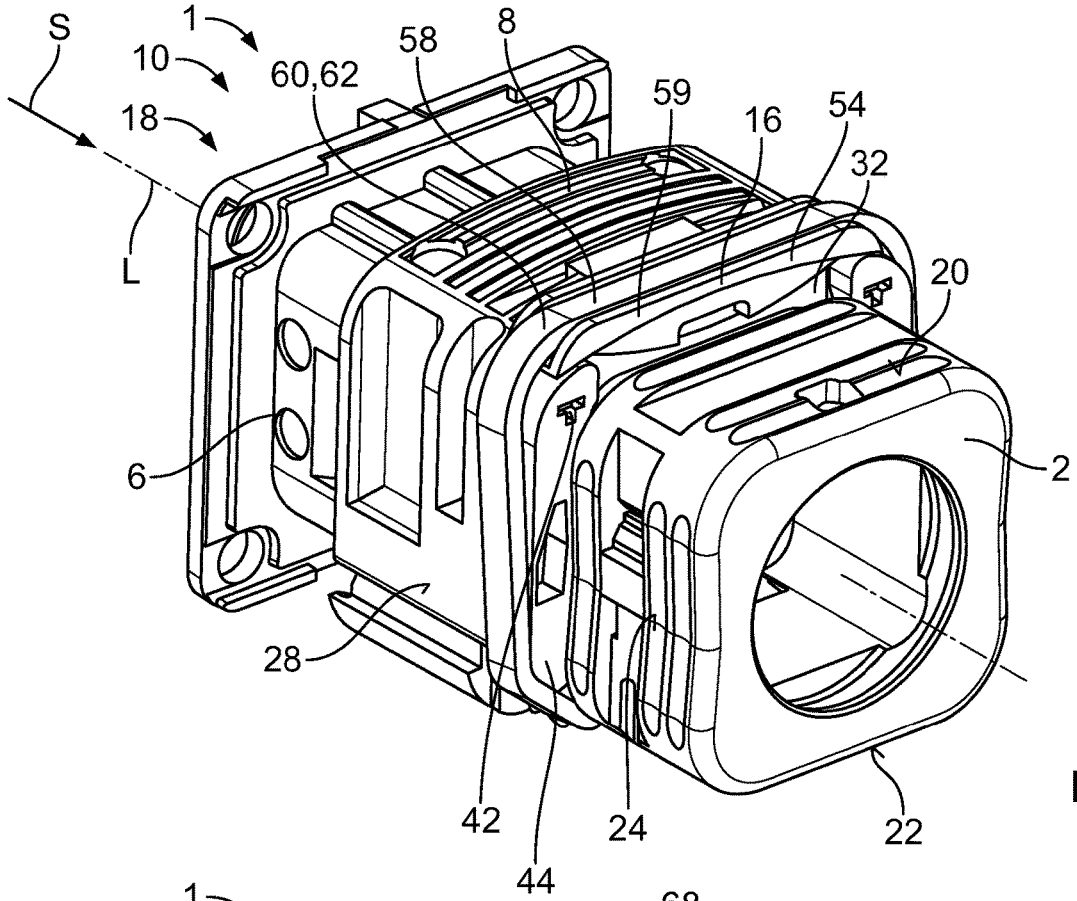
FIG. 5 is a perspective view of the electrical connector with a secondary securing element.

As shown in FIGS. 1-4, the handle 54 may have a notch 58 extending continuously from one lateral end to the other on an upper side facing away from the protrusion 56, the notch 58 perpendicular to the longitudinal axis L and being open to either lateral sides. The notch 58 is arranged between two flanks 59 and is adapted to receive a secondary securing element 60 as is shown in FIG. 5. The secondary securing element 60 may fix the securing tab 16 in the inserted state 18, so that the securing tab 16 may only be removed from the gap 14 by removal of the secondary securing element 60.

The secondary securing element 60 may, for example, be a tie wrap 62 as shown in FIG. 5, which is nestled in the notch 58 and wrapped around the housing 2 and the primary locking sleeve 8. Consequently, the secondary securing element 60 has to be opened with a tool, e.g. with scissors or the like. Thus, accidental removal of the securing tab 16 may be prevented. Because the protrusion 28 may prevent a movement of the primary locking sleeve 8 relative to the housing 2 essentially parallel to the longitudinal axis L and the relative movement of the primary locking sleeve 8 to the housing 2 essentially perpendicular to the longitudinal axis L may be coupled to the former movement, the latter movement is also prevented by the securing tab 16.

Figure 6:
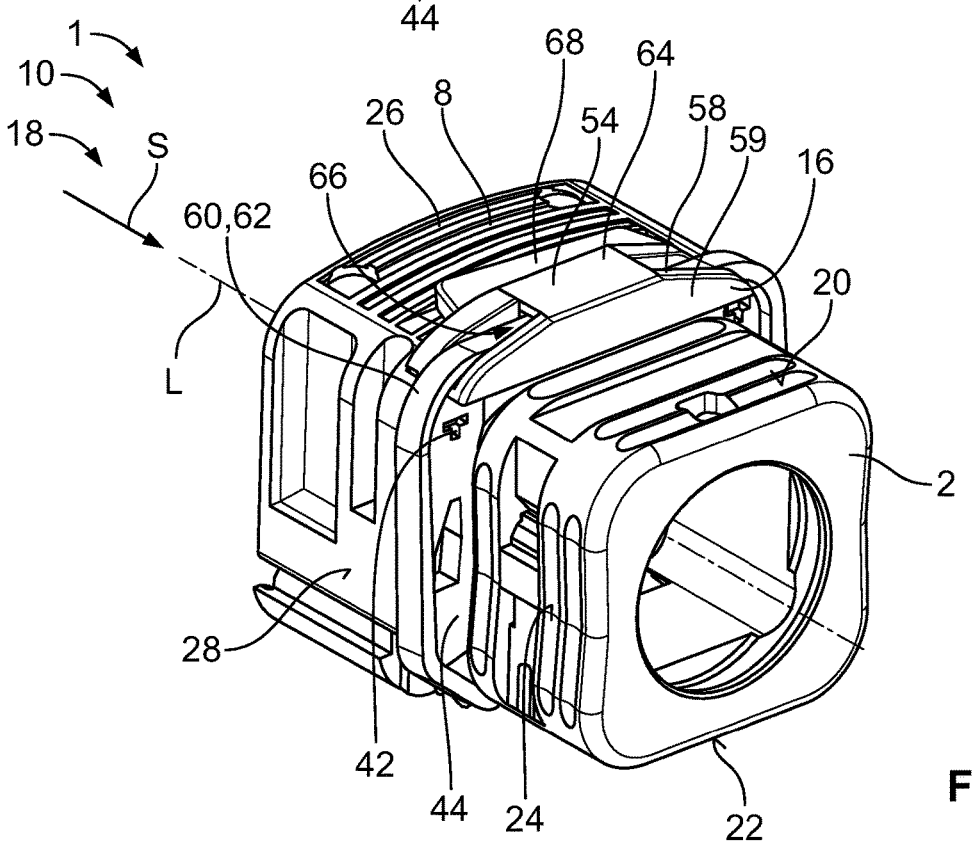
FIG. 6 is a perspective view of the electrical connector according to another embodiment.

With reference to FIG. 6, a further embodiment of the electrical connector 1 having a variation of the securing tab 16 is shown and described. The housing 2 and the primary locking sleeve 8 are the same as in the previous embodiment. For the sake of brevity, only the differences of the securing tab 16 of the second embodiment to the securing tab 16 of the first embodiment are described herein.

The securing tab 16 in the embodiment shown in FIG. 6 may comprise a flange 64 extending from one flank 59 to the other at a free end of the flanks 59 in the direction perpendicular to the longitudinal axis L. The flange 64 may thus form a tunnel section 66. Hence, the secondary securing element 60 may be prevented from slipping off the notch 58 by the flange 64, once the secondary securing element 60 is mounted in the notch 58. Of course, the notch 58 of the first embodiment may also comprise a tunnel section 66 by having a flange 64 extending between the two flanks 59 at their free ends.

The notch 58 and the protrusion 56 may be arranged staggered to one another along the longitudinal axis L. The notch 58 may thus be arranged at a portion of the electrical connector 1 having a lower radial size than its immediate surroundings along the longitudinal axis L, thus ensuring that the secondary securing element 60 may be wrapped firmly around the electrical connector 1 without slipping and/or tilting along the longitudinal axis L.

The handle 54 may comprise a blocking protrusion 68, shown in FIG. 6, extending along the longitudinal axis L and covering an actuation portion of the primary locking sleeve 8. The blocking portion 68 may additionally provide an enlarged surface on which a signal may be arranged, such as a warning sign or the like. In an embodiment, the blocking protrusion 68 and the notch 58 may be arranged on opposing sides of the protrusion 56 along the longitudinal axis L, setting the center of gravity along the longitudinal axis L further towards the protrusion 56, providing a balanced securing tab 16 by shifting the center of gravity further towards the portion of the securing tab 16 that is arranged with the gap in a plane essentially perpendicular to the longitudinal axis L.

What is claimed is:

1. An electrical connector, comprising:

a housing having a receptacle open in a connection direction essentially parallel to a longitudinal axis, the receptacle receiving a complementary connector;

a primary locking sleeve disposed on the housing and movable relative to the housing between a locked position securing the electrical connector and the complementary connector and a release position for connecting and/or disconnecting the electrical connector and the complementary connector, a gap having a gap width is disposed between the housing and the primary locking sleeve at least in the locked position, the gap width decreases from the locked position to the release position;

a securing tab insertable at least partially into the gap to an inserted state to secure the primary locking sleeve in the locked position; and a secondary securing element securing the securing tab in the inserted state.

2. The electrical connector of claim 1, wherein the securing tab is inserted into the gap in a direction essentially perpendicular to the longitudinal axis.

3. The electrical connector of claim 1, wherein the securing tab has a handle arranged outside of the gap in the inserted state.

4. The electrical connector of claim 3, wherein the securing tab has a protrusion extending from the handle.

5. The electrical connector of claim 4, wherein the protrusion is arranged in the gap in the inserted state.

6. The electrical connector of claim 5, wherein the protrusion is fittingly inserted into the gap in the locked position.

7. The electrical connector of claim 4, wherein the securing tab has a notch.

8. The electrical connector of claim 7, wherein the notch is formed on a side of the handle facing away from the protrusion.

9. The electrical connector of claim 7, wherein the securing tab has a flange closing the notch, the flange forming a tunnel section.

10. The electrical connector of claim 7, wherein the protrusion and the notch are arranged staggered to one another along the longitudinal axis.

11. The electrical connector of claim 7, wherein the secondary securing element is received in the notch.

12. The electrical connector of claim 11, wherein the secondary securing element is wrapped around the securing tab and at least one of the housing and the primary locking sleeve.

13. The electrical connector of claim 1, wherein the securing tab has a blocking protrusion extending along the longitudinal axis.

14. The electrical connector of claim 13, wherein the blocking protrusion covers an actuation portion of the primary locking sleeve in the inserted state.

15. An electrical connector, comprising:

a housing having a receptacle open in a connection direction essentially parallel to a longitudinal axis, the receptacle receiving a complementary connector;

a primary locking sleeve disposed on the housing and movable relative to the housing between a locked position securing the electrical connector and the complementary connector and a release position for connecting and/or disconnecting the electrical connector and the complementary connector, a gap having a gap width is disposed between the housing and the primary locking sleeve at least in the locked position, the gap width decreases from the locked position to the release position; and a securing tab insertable at least partially into the gap to an inserted state to secure the primary locking sleeve in the locked position, wherein the housing and/or the primary locking sleeve has a bearing in which a biasing spring is mounted, the bearing is open toward the gap and, in the inserted state, the securing tab overlaps with an opening of the bearing in a direction essentially perpendicular to the longitudinal axis.

16. The electrical connector of claim 15, wherein the biasing spring has an arch section abutting an opposite wall of the gap.

17. The electrical connector of claim 16, wherein the securing tab and the arch section are arranged staggered to one another in the inserted state.

18. An electrical connector, comprising:

a housing having a receptacle open in a connection direction essentially parallel to a longitudinal axis, the receptacle receiving a complementary connector;

a primary locking sleeve disposed on the housing and movable relative to the housing between a locked position securing the electrical connector and the complementary connector and a release position for connecting and/or disconnecting the electrical connector and the complementary connector, a gap having a gap width is disposed between the housing and the primary locking sleeve at least in the locked position, the gap width decreases from the locked position to the release position;

a securing tab insertable at least partially into the gap to an inserted state to secure the primary locking sleeve in the locked position; and at least one spring biasing the primary locking sleeve into the locked position.

19. The electrical connector of claim 18, wherein the at least one spring includes a first spring biasing the primary locking sleeve in a direction perpendicular to the longitudinal axis.

20. The electrical connector of claim 19, wherein the at least one spring further includes a second spring biasing the primary locking sleeve in a direction parallel to the longitudinal axis.

* * * * *